United States Patent [19]

Hartmann et al.

[11] Patent Number: 4,640,115

[45] Date of Patent: Feb. 3, 1987

[54] STRAIGHTENING DEVICE

[75] Inventors: Franz-Josef Hartmann, Paderborn; Heinz Hefendehl, Altenbeken, both of Fed. Rep. of Germany

[73] Assignee: Benteler-Werke AG, Paderborn, Fed. Rep. of Germany

[21] Appl. No.: 752,389

[22] Filed: Jul. 3, 1985

[30] Foreign Application Priority Data

Jul. 3, 1984 [DE] Fed. Rep. of Germany ..... 3424439

[51] Int. Cl.[4] ..... B21D 3/04

[52] U.S. Cl. ..... 72/98; 72/95; 72/428

[58] Field of Search ..... 72/95, 96, 97, 98, 99, 72/251, 428; 226/171, 172, 196

[56] References Cited

U.S. PATENT DOCUMENTS

| | | | |
|---|---|---|---|
| 803,079 | 10/1905 | Thust | 72/96 |
| 1,141,426 | 6/1915 | Simpkins | 72/97 |
| 1,882,655 | 10/1932 | Clark | 72/96 |
| 1,985,757 | 12/1934 | Abramsen | 72/95 |
| 1,992,360 | 2/1935 | Diescher | 72/96 |
| 2,050,049 | 8/1936 | Findlater | 72/428 |
| 2,348,786 | 5/1944 | Colby | 72/99 |
| 2,893,348 | 7/1959 | Pearson | 414/748 |
| 3,533,257 | 10/1970 | Aldred | 72/99 |
| 3,688,542 | 9/1972 | Platko | 72/428 |
| 3,969,919 | 7/1976 | Goeke | 72/428 |

FOREIGN PATENT DOCUMENTS

| | | | |
|---|---|---|---|
| 737036 | 5/1980 | U.S.S.R. | 72/97 |

*Primary Examiner*—Lowell A. Larson
*Attorney, Agent, or Firm*—Michael J. Striker

[57] ABSTRACT

In order to increase output of pipe straightening devices, there is provided a driving unit between a preparatory station for the pipes and a feeding station which advances the pipes from the preparatory station in axial direction one after the other in the feeding station. The feeding station includes a succession of rotation symmetrical guiding elements supported for rotation about axes which extend parallel to the feeding path for the pipes. The guiding bodies prevent striking of unbalanced pipes against the feeding unit and permit axial feeding of the pipes in a straightening station.

14 Claims, 6 Drawing Figures

FIG. 3
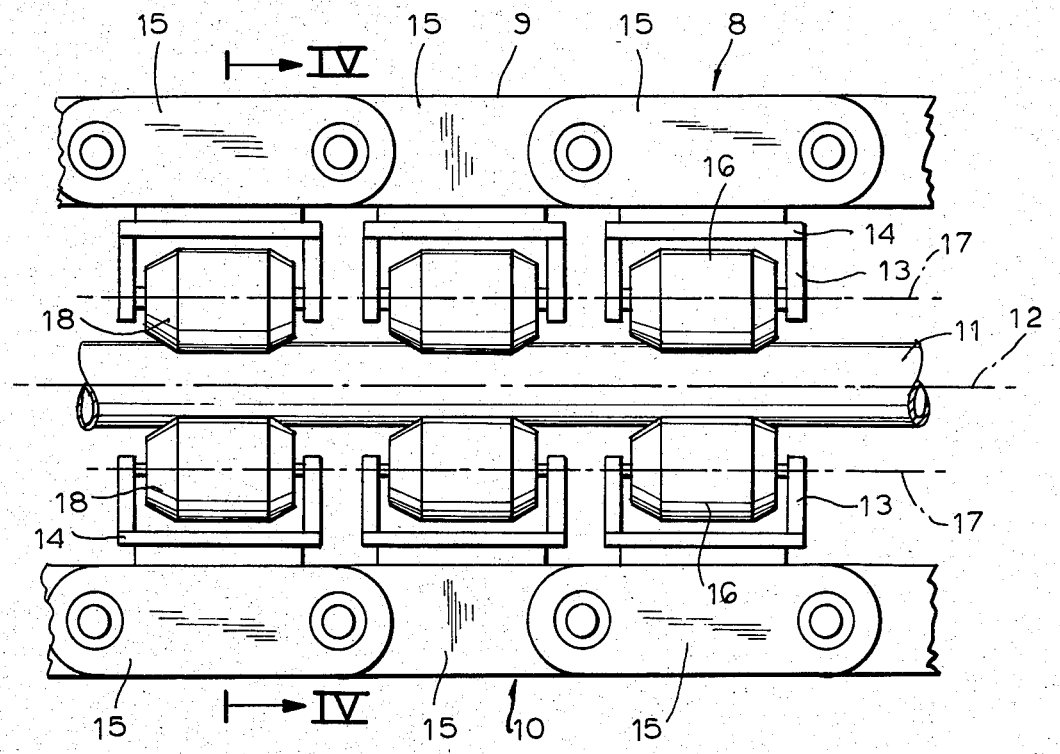
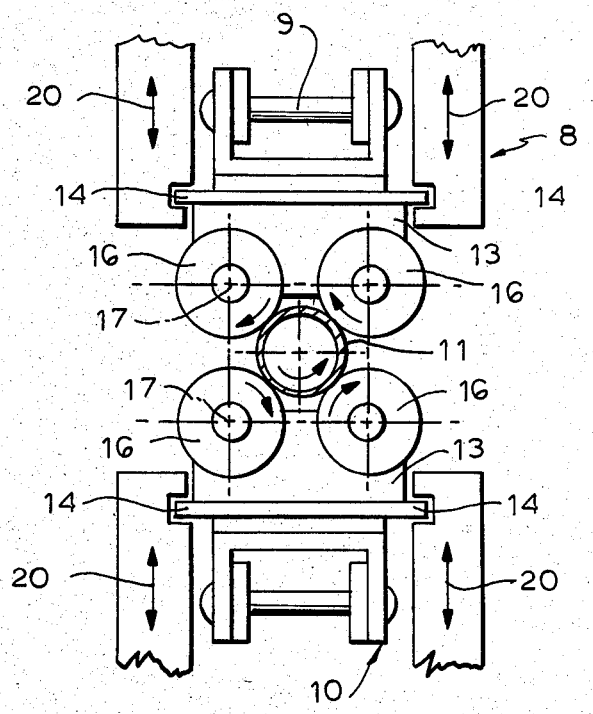
FIG. 4

STRAIGHTENING DEVICE

BACKGROUND OF THE INVENTION

The present invention relates to a straightening device for elongated round articles, particularly for rods or pipes, of the type which includes a preparatory station for receiving the articles to be straightened, a feeding unit for taking over the articles from the preparatory station and a straightening station arranged subsequent to the feeding station and having driven inclined rollers in alignment with the feeding path of the feeding station.

Due to the preliminary treatment of rods or seamless or welded pipes of steel or non-ferrous metals, for example in drawing machines or rolling mills or in the subsequent feed treatment units, it is normally necessary to straighten such articles before their further processing. For this purpose, straightening machines are known which include inclined rollers rotating at a predetermined rotary speed and calibrated according to a particular range of diameters of the processed pipes.

Due to the calibration of the inclined straightening rollers and in view of a particular diameter of the processed article, the straightening rollers must be adjusted to a certain inclined position at which the articles are processed at desired feeding and rotary speeds. In other words, when the processed articles are of smaller diameter, the straightening rollers must be more inclined in the direction of the center axis of the articles than in the case of larger diameters. Accordingly there is an immediate dependency between the feeding speed and the rotary speed of the processed articles and the angle formed by the longitudinal or center axis of the processed article and the axis of rotation of respective straightening rollers. In addition, at a smaller diameter of the processed article, the rotary speed of the rollers is greater than in the case of larger diameters whereas the feeding speed for articles of smaller diameters must be reduced.

Under these considerations an inference might be drawn that in order to increase output of straightened rods or pipes, only the rotary speed of the straightening rollers must have been increased. Such a measure, however would result in a prohibitive range of rotary speeds of the processed articles. As known, articles of a length of approximately 20 meters tend under the influence of rotary speed and due to their imbalance to jump out of their place and strike against the trough-shaped feeding units. Such strikes become the more stronger the higher is the rotary speed and the more bent is the article. Consequently, the noise levels is excessively increased.

The loading of prior art feeding stations from the prepararory stations takes place along a lateral side of the latter, mostly by separating individual articles from a bundle of articles made ready on the preparatory station. For this purpose, inlet gates have been already developed having relatively narrow clearance. If such inlet gates are opened, their cross-section is sufficiently large for permitting the reception even of strongly bent elongated articles, which upon closing of the gate, still are accommodating in the inlet gate or groove. The reduction of the cross-section of the inlet gate therefore must not reach a point in which the article is clamped and cannot be introduced in the straightening station. In addition, the article in the inlet gate must have sufficient freedom of movement so as to permit straightening rollers to set it in rotation and advance it without problems.

Accordingly, hitherto a compromise had to be made between the desired productive efficiency on the one hand and the rotary speed of the processed article on the other hand in order to avoid damages of the upper surface of the articles caused by the strokes against the inlet gates. In practice, this compromise results in a straightening speed of about 60 meters per minute which can be increased to about 100 meters per minute provided that almost straight articles are fed in and consequently an intake or inlet gate of reduced diameter is needed.

Another critical point of the known straightening devices is the lateral loading of the feeding units with the articles to be processed. As long as the article is present in an inlet gate which is at least partially closed at its top, the subsequent article can be held in a standby position above the inlet gate but cannot be introduced in the latter. It can be inserted in the inlet gate only after the discharge of the preceding article. This circumstance, under considering an average straightening speed, necessitates time intervals of about 5 seconds between pipe length of 7 to 8 meters. Such time intervals represent ineffective times in the operation of the straightening device.

In view of the fact that in prior art straightening devices the articles to be processed are introduced laterally from the preparatory station in the feeding station, there is an additional disadvantage in the necessity of manipulation of the articles by the attending personnel. It has turned out that in general a worker can handle articles up to 8 meters long of an average diameter. For articles between 8 meters and 20 meters of length, however, two workers are necessary for shifting the article in the feeding unit. Moreover, since the articles are mostly received on the preparatory unit in jammed bundles, the separation of the articles can be made with an extraordinary effort.

In summary, due to the limited rotary speeds of the processed articles, due to the lateral loading of the articles in the feeding units, due to the requirement of at least two workers for handling longer articles as well due to the necessity of a discontinuous loading of the articles in the device caused by the fact that an article cannot be inserted in the inlet gate before the preceding article is completely discharged the effective operational time of prior art straightening devices amounts only to about 50%.

SUMMARY OF THE INVENTION

It is therefore a general object of the present invention to avoid the disadvantages of prior art straightening devices.

In particular, it is an object of this invention to provide an improved straightening device in which the rate of utilization is substantially increased.

Another object of this invention is to provide such an improved device in which service time is increased, the noise level is reduced and the necessity of manipulation by attending personnel during the loading is reduced to minimum.

In keeping with these objects and others which will become apparent hereinafter, one feature of the invention resides, in a straightening device of the before described type, in the provision of a driving unit having a plurality of driving rollers for engaging the articles in the preparatory station and consecutively advancing the articles in axial direction into the feeding station, the feeding station including an array of rotation symmetrical bodies arranged in spaced relation one after the other to engage circumferential portions of respective articles exiting in the axial direction from the driving unit and the rotation symmetrical bodies being supported for rotation about axes which extend parallel to the center axis of the processed article.

A characteristic feature of this invention is the axial insertion of the articles in the feeding unit. The articles to be processed are delivered mostly in clusters on the preparatory station in the form of a depositing table or of a vertically adjustable lifting trough, are engaged by a single worker or also automatically at one end and brought in a position above the driving unit whereby the opposite end of the article can still be in the cluster. When the preceding article has exited the driving unit, the end portion of the article which has been positioned above the driving unit is automatically advanced in the feeding station and is introduced therein in axial direction without any substantial delay. The interval between the rear end of the preceding article and the beginning of the new article is minimum. The length of the article is irrelevant because the driving unit separates without problems from the cluster articles of any length.

In the feeding unit the article is carried by the rotational symmetrical guiding bodies which engage the article on its circumference and are rotatable parallel to its londitudinal axis. The rotation symmetrical guiding bodies do not exert any resistance to the rotation of the processed article by the straightening rollers even when the guiding bodies closely engage the article. The engagement of the article with the rotary guiding bodies occurs only at those circumferential portions of the article which are bent relative to the feeding direction. In view of the fact that the play between the processed article and the passage delimited by the guiding bodies is minute and that a contact occurs only in the range of the curvature of the processed article, impacts of the articles against feeding unit as well as noise are substantially reduced. By virtue of the axial feed of the articles and due to the rotary support of guiding bodies which are uniformly distributed around the processed article over the entire length of the feeding station, substantially higher rotary and feeding speeds of the processed articles are now feasible in comparison with those in prior art straightening devices. As a consequence, substantially higher productivity is achieved and simultaneously the upper surface of the processed articles is spared damage. Straightening speeds of about 150 meters per second can be obtained without difficulties.

In the preferred embodiment of this invention, the guiding bodies are supported for rotation about axes in the feeding direction on opposite articulated endless conveyors circulating in synchronism with one another in the feeding direction. In this manner, the articles are surrounded at different locations over the entire length of the feeding station by four guiding rollers which are mutually staggered by about 90° at respective circumferential portions of the article. Due to the circulating articulated conveyors two opposite pairs of guiding rollers which appear at the same time at the beginning of the feeding station, are brought more or less in contact with circumferential portions of the article exiting from the driving unit and are moved synchronously with the article through the entire length of the feeding unit and are deviated at the other end of the latter in transverse direction to be returned to the inlet of the feeding unit. In this manner no relative movement in the feeding direction is produced between the guiding rollers and the processed articles. The guiding rollers rotate only in the event when due to a bend of the elongated article a surface portion is brought into contact with the corresponding guiding roller. Such an engagement, however, imparts only a low torsional resistance to the processed articles. The synchronization of the articulated conveying loops with respect to the direction and speed depends on the rotary speed of straightening rollers in the straightening station. In this manner a trouble-free synchronization of the movements of the article in the feeding unit and in the straightening unit is achieved and no longitudinal or transverse stresses occur.

Due to the adjustment of circulating speeds of the articulated conveying members to the rotary speed of straigthening rollers a feed of the articles is forced in the same direction and with the same speed as the straightening rollers. The rotation imparted to the articles by the straightening rollers is taken up by the idling guiding rollers without generating any significant resistance to the rotation of the article.

In order to match different diameters of articles to straightening rollers the clearance between the facing runs of the articulated conveying loops is adjustable. This is made possible by adjusting the position of both conveyors to the feeding path.

The position of the articulated conveyors relative to the articles is generally of no consequence. In the preferred embodiment, however, the articulated conveyors are in the form of link chains arranged in a vertical plane below and above the feeding path. The link chains have the advantage of easy maintenance and can be without problems engaged with guiding means which insure the synchronization of movement of the guiding rollers parallel to the longitudinal axis of the articles.

Preferably, the links of the chain links have a length which permits the arrangement of one pair of guiding rollers on each link. In this manner the processed article is enclosed at a plurality of points by the guiding rollers so as to obtain exact guiding effect without constraint.

In order to prevent damaging of the upper surface of processed articles at the ends of the feeding station during the approach or depature of the articulated conveyors, the edges at the end faces of the guiding rollers are beveled.

In another preferred embodiment of this invention the guiding bodies are in the form of short guiding pipes oriented in the direction of feeding of the articles and having an inner diameter which is smaller than the double outer diameter of the article. The ends of such guiding pipes are supported for rotation in roller bearings. Since the guiding pipes are relatively short only those pipes are brought into rotation where a contact is established with a curved portion of the processed article. In contrast to the before described embodiment employing articulated conveying members, in this embodiment the processed articles are not advanced by the guiding pipes. The feeding in longitudinal direction is effected exclusively by the straightening rollers in cooperation with the driving unit. Since the inner diameter of the guiding pipes is not greater than the double diameter of the processed article, also this embodiment can operate at a very high straightening speed which can be in the order of about 150 meters per minute.

To insure a problem-free matching of the device to different diameters of processed articles, each guiding pipe is rotatably supported in a turret head whose axis of rotation extends substantially parallel to the longitudinal axis of the article. For example, four guiding pipes are uniformly distributed around the axis of rotation of the turret head whereby a certain range of diameters of the articles is assigned to each of the guiding pipes. In processing articles of a different diameter it suffices to turn the turret head so as to bring into operative position that guiding pipe whose inner diameter is smaller than the double diameter of the corresponding article.

To facilitate the transition from one guiding pipe to another one, the run on ends of the guiding pipes have a funnel-like configuration.

In order to insure a trouble free transition of the processed article from the driving unit in the feeding station, especially in the embodiment using articulated conveying means, the driving unit employs a guiding tube directed to the inlet of the feeding station. The guiding tube bridges the gap between the driving unit and the feeding station and projects with its free end immediately between the arcuate deviation sections of the articulated conveying members.

The driving unit is provided with vertically oriented driving rollers engaging from both sides an article separated from a bundle on the preparatory station whereby the clearance between the facing vertical driving rollers is adjustable. The adjustment of the clearance between the driving rollers relative to the driven article can be made by a contactless switch. The driving rollers can be immediately opened when a leading section of the processed article of a length of about 1 to 2 meters has entered the feeding station. The leading portion of a subsequent article which has been brought already in standby position can be automatically passed between the driving rollers as soon as the preceding article has left the driving unit. Thereafter the continuously rotating driving rollers are moved against each other so that the new article is immediately advanced.

The interspace resulting from the exchange of articles in the driving unit can be eliminated in such a way that feeding speeds of the articles in the driving unit exceeds the feeding speed of the article in the feeding station. It is conceivable that the driving rollers in the driving unit can be moved away from one another when the leading portion of the new article has reached the guiding rollers on the articulated conveying means, thus assuming a ready position for the following article. The automatic adjustment of the speeds of the articulated conveying means to the straightening speed can be achieved for example in such a manner that the ends of an article during its passage through the straightening rollers is measured for a path of travel of 1 meter, for example, and the ascertained speed value is simultaneously transmitted to the articulated conveyors.

The increased feeding speeds of the driving unit in comparison to the feeding speed of the article between the articulated conveying means is preferably obtained by an automatically adjustable drive for the driving rollers, such as for example a hydraulic drive.

An additional protection of the upper surface of the processed articles is obtained by providing an intermediate driving unit between the feeding station and the straightening station, the intermediate driving unit being synchronized with the inclined rollers of the straightening station and having mutually adjustable inclined rollers. The difference between the inclined rollers of the intermediate driving units and those of the straightening station is due to fact that during the entry of the article into the driving unit its inclined rollers do not engage the article. Only after the leading portion of the article has entered about 1 meter into the intermediate driving unit the inclined rollers are pressed on the article, set the latter in rotary motion and feed the same in synchronism with the rotary speed and feeding speed in the straightening station. The integration of the intermediate driving unit between the feeding and straightening stations has the additional advantage that upon the entry of the article in the straightening section no excessive load of the first straigtening roller pair can occur, and in this manner a risk of damage of the upper surface of the treated article is avoided.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

FIG. 3 is a plan view of the cut-away part III of FIG. 1, shown on an enlarged scale;

FIG. 4 is a sectional side view of a part of FIG. 3, taken along the line IV—IV;

DESCRIPTION OF THE PREFERRED EMBODIMENTS

Figure 1:
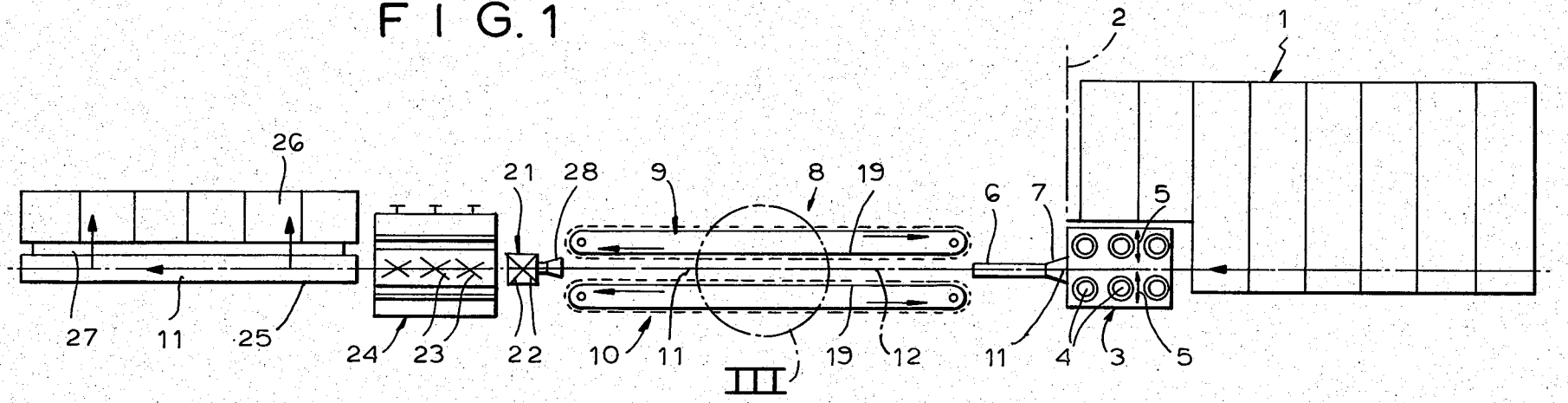
FIG. 1 is a schematic illustration of one embodiment of the straightening device for elongated, round articles, shown partially in a plan view and partially in an elevation view.

In FIG. 1, reference numeral 1 designates a preparatory station consisting for example of a depositing table for receiving elongated articles to be straightened, such as for example roung rods or pipes. The depositing table 1 is shown in a plan view. The depositing table which can be for example in the form of a vertically adjustable lifting trough, receives a non-illustrated bundle of pipes. The deposition of the pipes on the table occurs in such a manner that front ends of respective pipes abut against fixed wall indicated by line 2.

A driving unit 3 provided with vertically directed driven rollers 4 is arranged in the range of the depositing table 1 near the abutment wall 2. The vertical rollers 4 of the driving unit are driven hydraulically by a non-illustrated drive. The rollers 4 are arranged in rows opposite each other and the rollers in each row are movable in transverse direction as indicated by arrow 5. At the outlet end of the driving unit 3 there is provided a guiding tube 6 having a funnel shaped inlet piece 7. The guiding tube 6 is aligned with the central passage between the driving rollers 4 and is directed into the inlet of a feeding station 8. The feeding station in FIG. 1 is shown in an elevation view, namely turned by 90° relative to the preparatory station. The feeding station includes two positively guided articulated conveying means in the form of endless link chains 9 and 10. The link chains circulate in a vertical plane above and below the processed pipe 11 and are juxtaposed to each other. The pipe 11 in FIG. 1 is indicated only by its longitudinal axis 12.

Referring now to FIGS. 3 and 4 each link 15 of respective link chains 9 and 10 is provided with a U-shaped holder 13 which is secured to a longitudinal edge of the link. The base of each holder 13 has projecting lateral flanges 14 which are positively guided in guiding grooves formed in the frame of each chain. Each holder 13 supports for rotation a pair of guiding rollers 16 arranged side by side at a small distance one from the other. The axes of rotation 17 of respective guiding rollers 16 are parallel to the longitudinal axis of the processed pipe 11. The edges 18 of the cylindrical guiding rolls are beveled. The relative position of the guiding rolls of opposite pairs to the pipe 11 is such that circumferential portions of the pipe are surrounded and guided between four guiding rollers 16 mutually staggered by 90° (FIG. 4).

In order to match the feeding path to different diameters of the processed articles 11, at least the run 19 of the articulated conveyors facing the article 11 are adjustable relative to the latter. This adjustment is indicated by arrow 20 in FIG. 4.

Referring again to FIG. 1, the outlet of the feeding station 8 opens into an intermediate driving unit 21, shown in an elevation view. The driving unit 21 includes driven and profiled inclined rollers 22. The inclined rollers 22 are driven in synchronism with the straightening rollers 23 in the subsequent straightening station 24. The straightening station 24 is also illustrated in an elevation view. Straightened pipe 11 exiting in axial direction from the straightening station 24 is discharged on an outlet trough 25 and therefrom it is transferred in direction indicated by arrow 27 onto a collecting tray 26 for finished articles.

The operation of the device of FIG. 1 is as follows: a pipe 11 deposited on the depositing table 1 is seized at one end by a worker and positioned above the vertical driving rollers 4 so that the longitudinal axis of the pipe is aligned with the passage between the driving rollers. The trailing part of the pipe is still lying in a cluster of pipes on the depositing table 1. When the preceding processed pipe is dicharged from the driving unit 3 and the driving rollers 4 are moved into their open position as indicated by arrows 5, then the positioned end portion of the prepared pipe is automatically passed between the driving rollers 4 which automatically return to their closed position, for example in response to a non-illustrated contactless switch and firmly engage the pipe 11. Since the vertical driving rollers 4 of the drive unit 3 rotate continuously the pipe 11 is drawn in longitudinal direction from the cluster on the depositing table and exits through the guiding pipe 6 into the feeding station 8.

As soon as the leading portion of the processed pipe is advanced to a distance of 1 to 2 meters in the range of the feeding station 8, the vertical driving rollers 4 are again diverged so as to receive the subsequent pipe. Due to the exchange of pipes in the driving unit, an interval between the consecutive pipes is created. However, by adjusting a higher feeding speed in the range of vertical driving rollers 4 with respect to the speed of straightening rollers, this gap can be eliminated. This higher speed of driving rollers 4 is controlled by a non-illustrated hydraulic drive.

The speed of circulation of link chains 9 and 10 in the feeding station 8 is adjusted to the feeding speed of the straightening rollers 23. This adjustment is made automatically in such a manner that the time of travel over a path of about 1 meter in the range of rollers 23 is measured and the determined speed value signal is applied to a non-illustrated drive control for the link chains 9 and 10 and to the hydraulic drive for the driving roller 4. The speed of circulation of the link chains 9 and 10 determines a forced guiding of the processed pipe 11 in synchronism with the speed of straightening rollers 23. Depending on the inclined position of the straightening rollers 23, the latter enforce not only the feed but also introduce a rotary motion of the processed pipe 11. This rotation is taken up by the idling guiding rollers 16 on the links of the chains 9 and 10. Since the clearance between the facing link chains 9 and 10 can be changed so as to match the diameter of the pipe 11, any deviation of the pipe in the feeding station 8 which might be caused by centrifugal force, is prevented.

Upon discharge of the pipe from the feeding station 8 the leading end of pipe 11 enters a lead-in funnel 28 of an intermediate driving unit 21. At first, the inclined rollers 22 in the intermediate driving unit 71 do not engage the pipe 11. Only after the leading portion of pipe 11 has entered about 1 meter in the intermediate driving unit, the inclined rollers 22 are pressed against the pipe. Since the inclined rollers 22 rotate in synchronism with straightening rollers 23, the pipe 11 is set in a rotary motion and is advanced in the straightening station 24 with the same feeding and rotary speed.

After discharge of a straightened pipe 11 from the straightening station 24, it is deposited on an outlet trough 25 from which it is displaced in transverse direction indicated by arrows 27 on a tray 26 for finished articles.

Figure 2:
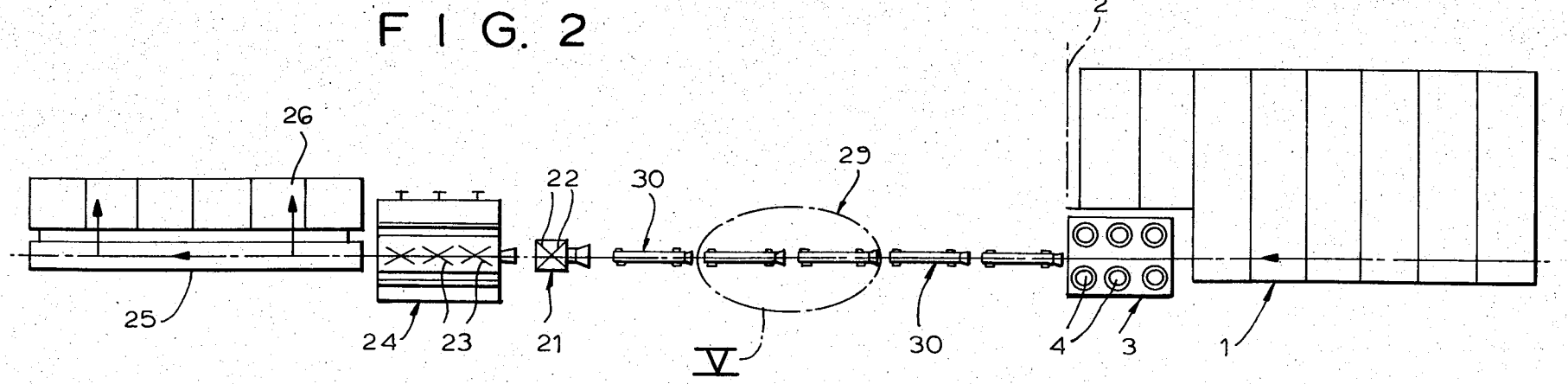
FIG. 2 is an illustration of another embodiment of the straightening device.
Figure 5:
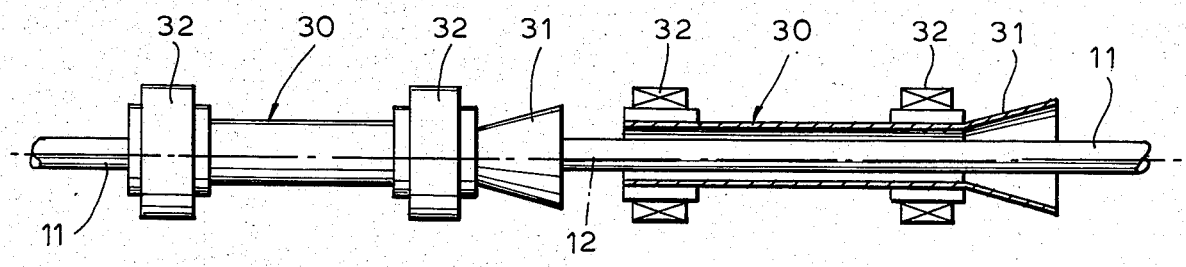
FIG. 5 is a plan view partly in section of the cut-away part V of FIG. 2, shown on an enlarged scale.

In the embodiment according to FIG. 2 the feeding station 29 includes a succession of short guiding tubes 30 arranged in alignment with the feeding path for the pipe 11, as illustrated in FIG. 5. The guiding tubes 30 have an inner diameter which is smaller than the double outer diameter of the processed pipe 11. The inlet ends 31 of respective guiding tubes 30 have a funnel-shaped extension. Each guiding tube 30 is supported for rotation in two bearings 32 which support each guiding tube for rotation coaxially with the longitudinal axis 12 of the processed pipe 11.

In this embodiment the depositing table 1, driving unit 3, intermediate driving unit 21, straightening station 24, outlet trough 25 and the tray 26 for completed articles correspond to the embodiment of FIG. 1.

Figure 6:
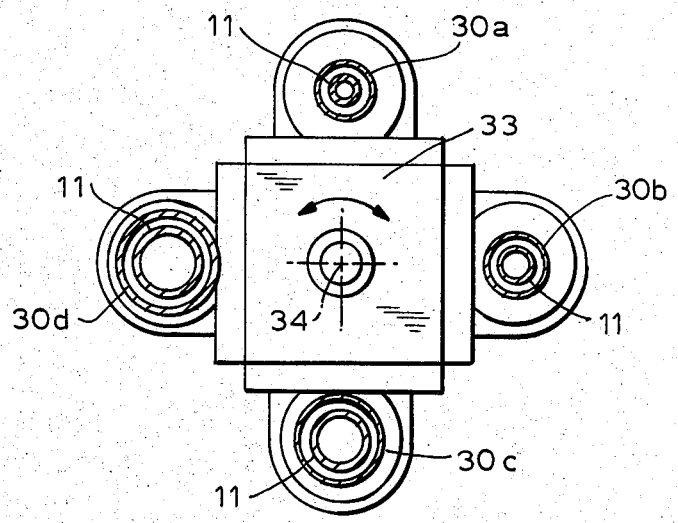
FIG. 6 is a side view of a modification of the device of FIG. 2, shown on an enlarged scale.

In order to match the guiding tube 30 to different diameters of the processed pipes, a set of guiding pipes **30*a* through 30*d* of different inner diameters can be supported for rotation on a turret head 33, as illustrated in FIG. 6. The axis of rotation 34 of the turret head extends substantially parallel to the longitudinal axis 12 of the processed pipe. In this manner, by rotating the turret head 33** it is possible to bring into starting position the guiding tube whose inner diameter is smaller than the double outer diameter of the processed pipe.

In the embodiment of FIGS. 2, 5 and 6, in contrast to the example of FIGS. 1, 3 and 4, no active feeding in the longitudinal direction of the processed pipe 11 will occur in the guiding tube 30. The longitudinal feed of the pipes is effected by the vertical driving rollers 4 in such a way that a pipe driven by the driving rollers pushes against the trailing end of the preceding pipe in the feeding station 29, and also by the intermediate driving unit 21 which engages by its rotary inclined rollers 22 the beginning of the pipe exiting from the feeding station. In order to obtain a minute gap of about 60 mm between the consecutive pipes in the range of the outlet from the straightening station and on the outlet trough 25, or to enable switching processes after the straightening operation, the inclined rollers 22 in the intermediate driving unit 21 rotate a little faster than the inclined straightening rollers 23 (in contrast to the vertical rollers 4 in the driving unit 3), the speed difference being in the order of about 10 percent.

It will be understood that each of the elements described above, or two or more together, may also find a useful application in other types of constructions differing from the types described above.

While the invention has been illustrated and described as embodied in specific examples of straightening devices for pipes, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A straightening device for elongated round articles defining a center axis, particularly for rods or pipes, comprising a preparatory station for receiving the articles to be straightened, a driving unit having a plurality of driving rollers for engaging the articles in the preparatory station and consecutively advancing the articles in axial direction into a feeding station which guides in axial direction said articles into a straightening station, the straightening station being provided with driven inclined straightening rollers, said feeding station including a set of rotation symmetrical bodies arranged in spaced relation one after the other to engage discrete circumferential portions of respective articles exiting in axial direction from said driving unit, said rotation symmetrical bodies being supported for free rotation about axes which extend parallel to the center axis of the processed articles; said feeding station including two articulated conveying members arranged in a vertical plane below and above a feeding path for the processed articles, said rotation symmetrical bodies being arranged in pairs side by side and one after the other on respective conveying members, so as to surround the processed article over the entire length of the feeding station, said articulated conveying members being positively guided to circulate in the same axial direction and at the same speed as that of the advancing articles.

2. A straightening device as defined in claim 1, wherein at least the runs of the articulated conveying members which face the processed article are adjustable in position relative to the center of said feeding path.

3. A straightening device as defined in claim 1, wherein said articulated conveying members are in the form of endless link chains circulating below and above said feeding path.

4. A straightening device as defined in claim 3, wherein each link of respective link chains support a pair of guiding rollers arranged side by side.

5. A straightening device as defined in claim 4, wherein the end edges of respective guiding rollers are beveled.

6. A straightening device as defined in claim 1, wherein said driving unit has an outlet provided with a lead-in tube directed into said feeding station.

7. A straightening device as defined in claim 1, wherein said driving unit includes vertical driving rollers arranged at opposite sides of a processed article and the position of said vertical driving rollers being adjustable relative to the center axis of said article.

8. A straightening device as defined in claim 7, wherein the feeding speeds of said vertical driving rollers is greater than the feeding speeds of the article in said feeding station.

9. A straightening device as defined in claim 1, wherein said driving unit has an automatically adjustable drive for said driving rollers.

10. A straightening device as defined in claim 1, further comprising an intermediate driving unit arranged between said feeding station and said straightening station, said intermediate driving unit including profiled inclined rollers driven in synchronism with inclined rollers in said straightening station.

11. A straightening device as defined in claim 10, wherein the mutual position of said profiled inclined rollers in said intermediate driving unit is adjustable.

12. A straightening device for elongated round articles defining a center axis, particularly for rods or pipes, comprising a preparatory station for receiving the articles to be straightened, a driving unit having a plurality of driving rollers for engaging the articles in the preparatory station and consecutively advancing the articles in axial direction into a feeding station which guides in axial direction said articles into a straightening station, the straightening station being provided with driven inclined straightening rollers, said feeding station including a set of rotation symmetrical bodies arranged in spaced relation one after the other to engage discrete circumferential portion of respective articles exiting in axial direction from said driving unit, said rotation symmetrical bodies being supported for free rotation about axes which extend parallel to the center axis of the processed articles, said rotation symmetrical bodies being in the form of short guiding tubes arranged one after the other coaxially with a feeding path for said elongated articles exiting from said driving unit and the inner diameter of said guiding tubes being smaller than the double outer diameter of the processed elongated articles.

13. A straightening device as defined in claim 12, wherein said feeding station includes a turret head arranged for rotation about an axis extending parallel to said feeding path for the processed articles, said turret head supporting guiding tubes of different inner diameters.

14. A straightening device as defined in claim 12, wherein inlet ends of respective guiding tubes are extended into a funnel-like shape.

* * * * *